US007816999B2

(12) United States Patent
Pashby et al.

(10) Patent No.: US 7,816,999 B2
(45) Date of Patent: Oct. 19, 2010

(54) SINGLE-POLE DOUBLE-THROW MEMS SWITCH

(75) Inventors: Gary Joseph Pashby, Milpitas, CA (US); Timothy G. Slater, Seattle, WA (US); Glenn Gottlieb, Los Gatos, CA (US)

(73) Assignee: Siverta, Inc., Milpitas, CA (US)

( * ) Notice: Subject to any disclaimer, the term of this patent is extended or adjusted under 35 U.S.C. 154(b) by 743 days.

(21) Appl. No.: 11/578,012

(22) PCT Filed: Apr. 12, 2005

(86) PCT No.: PCT/US2005/012244

§ 371 (c)(1),
(2), (4) Date: Oct. 10, 2006

(87) PCT Pub. No.: WO2005/099410

PCT Pub. Date: Oct. 27, 2005

(65) Prior Publication Data

US 2007/0205087 A1 Sep. 6, 2007

(51) Int. Cl.
*H01H 51/22* (2006.01)

(52) U.S. Cl. ..... 335/78; 438/406; 228/123.1

(58) Field of Classification Search ..... 335/78; 200/181; 29/622; 438/406–408; 228/123.1, 228/124.6, 174, 208
See application file for complete search history.

(56) References Cited

U.S. PATENT DOCUMENTS 5,278,368 A 1/1994 Kasano et al.
5,388,443 A * 2/1995 Manaka ..... 73/31.06
5,578,976 A 11/1996 Yao
5,619,061 A 4/1997 Goldsmith et al.
5,648,618 A 7/1997 Neukermans et al.
5,872,496 A 2/1999 Asada et al.
5,891,751 A 4/1999 Kurtz et al.
5,895,866 A 4/1999 Neukermans et al.
5,903,099 A 5/1999 Johnson et al.
5,969,465 A 10/1999 Neukermans et al.
5,994,750 A 11/1999 Yagi
6,044,705 A 4/2000 Neukermans et al.
6,069,540 A 5/2000 Berenz et al.
6,228,675 B1 5/2001 Ruby et al.
6,272,907 B1 8/2001 Neukermans et al.
6,307,169 B1 10/2001 Sun et al.
6,326,682 B1 12/2001 Kurtz et al.

(Continued)

FOREIGN PATENT DOCUMENTS

DE 41 13 190 C1 7/1992

(Continued)

OTHER PUBLICATIONS

Chiao, Jung-Chih, Fu, Yiton, Choudhury, Debabani, Lin, Lih-Yuan, "MEMS Millimeterwave Components," 1999 IEEE MTT-S International Microwave Symposium.

(Continued)

*Primary Examiner*—Elvin G Enad
*Assistant Examiner*—Bernard Rojas
(74) *Attorney, Agent, or Firm*—Donald E. Schreiber

(57) ABSTRACT

MEMS switches of varying configurations provide individually acutatable contacts. The MEMS switches are sealed by an improved anodic bonding technique.

9 Claims, 7 Drawing Sheets

U.S. PATENT DOCUMENTS

| | | | | |
|---|---|---|---|---|
| 6,384,353 | B1 | 5/2002 | Huang et al. | |
| 6,392,220 | B1 | 5/2002 | Slater et al. | |
| 6,410,360 | B1 | 6/2002 | Steenberbge | |
| 6,426,013 | B1 | 7/2002 | Neukermans et al. | |
| 6,441,481 | B1 | 8/2002 | Karpman | |
| 6,465,281 | B1 | 10/2002 | Xu et al. | |
| 6,507,097 | B1 | 1/2003 | Goetz et al. | |
| 6,511,894 | B2 | 1/2003 | Song | |
| 6,528,344 | B2 | 3/2003 | Kang | |
| 6,535,091 | B2 | 3/2003 | Bechtle et al. | |
| 6,537,892 | B2 * | 3/2003 | Jordan et al. | 438/406 |
| 6,589,625 | B1 | 6/2003 | Kothari et al. | |
| 6,603,182 | B1 | 8/2003 | Low et al. | |
| 6,624,003 | B1 | 9/2003 | Rice | |
| 6,701,779 | B2 | 3/2004 | Volant et al. | |
| 6,756,310 | B2 | 6/2004 | Kretschmann et al. | |
| 6,791,731 | B2 | 9/2004 | Ryu et al. | |
| 6,806,557 | B2 | 10/2004 | Ding | |
| 6,809,412 | B1 | 10/2004 | Tourino et al. | |
| 6,828,674 | B2 | 12/2004 | Karpman | |
| 7,449,765 | B2 * | 11/2008 | Ehmke et al. | 257/618 |
| 2002/0146919 | A1 | 10/2002 | Cohn | |
| 2002/0160583 | A1 | 10/2002 | Song | |
| 2002/0179986 | A1 | 12/2002 | Orcutt et al. | |
| 2005/0023629 | A1 | 2/2005 | Ding et al. | |
| 2008/0261344 | A1 * | 10/2008 | Jafri et al. | 438/51 |

FOREIGN PATENT DOCUMENTS

| | | | |
|---|---|---|---|
| EP | 0 608 816 | A | 8/1994 |
| EP | 1 388 875 | A2 | 2/2004 |
| JP | 2002-334645 | | 11/2002 |
| WO | WO 99/62089 | | 12/1999 |
| WO | WO 2004/013898 | A2 | 2/2004 |

OTHER PUBLICATIONS

Hah, Dooyoung, Yoon, Euisik and Hong, Songcheol, "A Low Voltage Actuated Micromachined Microwave Switch Using Torison Springs and Leverage," 2000 IEEE MTT-S Digest, pp. 157-160.

Hah, Dooyoung, Yoon, Euisik and Hong, Songcheol, "A Low-Voltage Actuated Micromachined Microwave Switch Using Torison Springs and Leverage," IEEE Transactions on Microwave Theory and Techniques, vol. 48, No. 12, Dec. 2000, pp. 2540-2545.

Hah, Dooyoung, Yoon, Euisik and Hong, Songcheol, "Low Voltage Actuated RM Mems Switches Using Push-Pull Operations," Extended Abstracts of the 2000 International Conference on Solid State Devices and Materials, Sendai, 2000, pp. 392-393.

Milanovi, Veljko, Maharbiz, Michel, Singh, Angad, Warneke, Brett, Zhou, Ningning, Chan, Helena K. and Pister, Kristofer S. J., "Microrelays for Batch Transfer Integration in RF Systems," 13th Int. IEEE MEMS Conf. Tech. Dig., Miyazaki, Japan, Jan. 23-27, 2000, pp. 787-792.

Veljko Milanovi, Michel Maharbiz and Kristofer S. J. Pister, "Batch Transfer Integration of RF Microrelays," IEEE Microwave and Guided Wave Letters, vol. 10, No. 8, Aug. 2000, pp. 313-315.

Varadan, Vijay, Vinoy, K. J., Jose, K. A., "RF MEMS and Their Application," Chapter 1 "Microelectromechanical Systems (MEMS) and Radio Frequency Mems," Wiley, Dec. 2002, pp. 1-49.

* cited by examiner

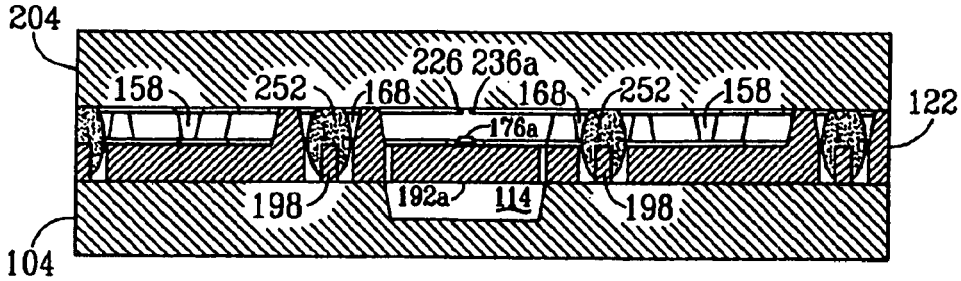
FIG. 9
FIG. 10
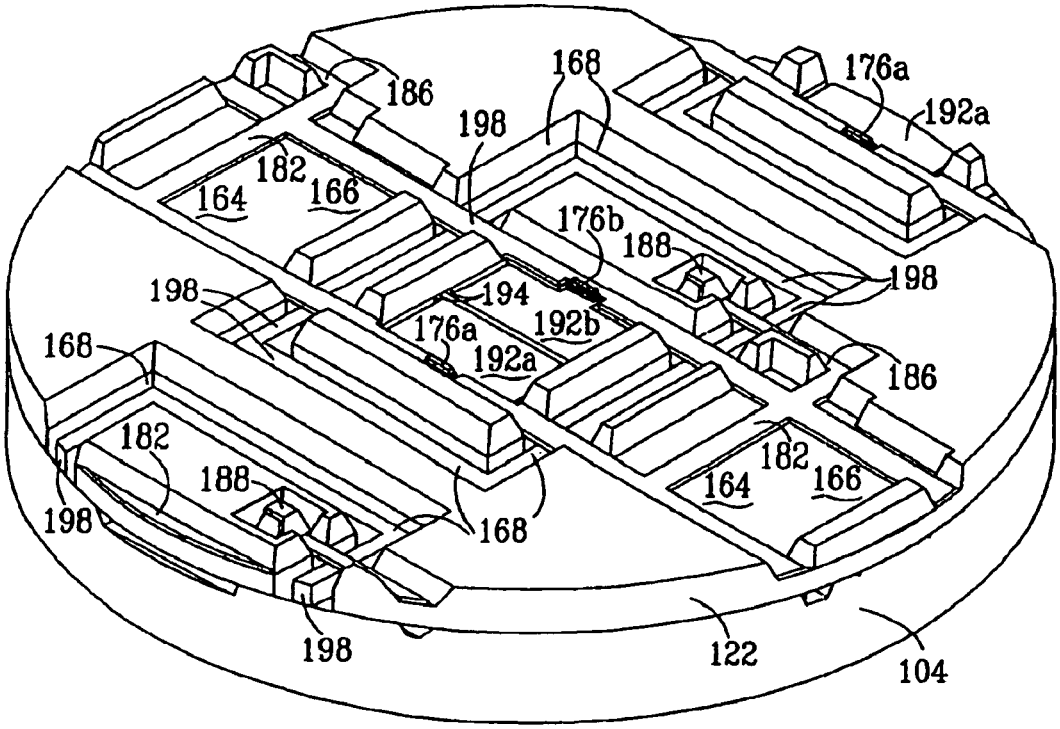

SINGLE-POLE DOUBLE-THROW MEMS SWITCH

TECHNICAL FIELD

The present invention relates generally to the technical field of electrical switches and relays, and, more particularly, to micro-electro mechanical systems ("MEMS") switches relays.

BACKGROUND ART

Patent Cooperation Treaty ("PCT") International patent application PCT/2003/024255 entitled "Sealed Integral MEMS Switch," published 12 Feb. 2004, with International Publication Number WO 2004/103898 A2 ("the PCT patent application"), discloses an integral MEMS switch which couples an electrical signal present on a first input conductor either to:

1. a single output conductor; or
2. to either a first or a second output conductor.

The MEMS switch disclosed in the PCT patent application includes a micro-machined monolithic layer of material having:

a. a seesaw;
b. a pair of torsion bars that are disposed on opposite sides of and coupled to the seesaw, and which establish an axis about which the seesaw is rotatable; and
c. a frame to which ends of the torsion bars furthest from the seesaw are coupled.

The frame supports the seesaw through the torsion bars for rotation about the axis established by the torsion bars. The seesaw carries either one or two electrically conductive shorting bars that are located away from the rotation axis established by the torsion bars at either one or both opposite ends of the seesaw.

The MEMS switch also includes a base that is joined to a first surface of the monolithic layer. A substrate, also included in the MEMS switch, is bonded to a second surface of the monolithic layer that is located away from the first surface thereof to which the base is joined. Formed on the substrate are either one or two electrodes which are juxtaposed respectively with a surface of the seesaw that is located to one side of the rotation axis established by the torsion bars. Applying an electrical potential between one electrode and the seesaw urges the seesaw to rotate about the rotation axis established by the torsion bars thereby narrowing a gap existing between the electrode and the seesaw.

Also formed on the substrate are either one or two pairs of switch contacts each of which connect to the input conductor and to the output conductor or respectively to the two output conductors. The pair or pairs of switch contacts:

a. are disposed adjacent to but spaced apart from the shorting bar(s) when no force is applied to the seesaw;
b. are electrically insulated from each other when no force is applied to the seesaw; and
c. upon application of a sufficiently strong force to the seesaw which urges the seesaw to rotate are contacted by a shorting bar.

In this way, contact between the shorting bar and a pair of switch contacts electrically couples together the input conductor with an output conductor.

Another aspect of the PCT patent application is a MEMS electrical contact structure and a MEMS structure which includes a first and a second layer each of which respectively carries an electrical conductor. The second layer also includes a cantilever which supports an electrical contact island at a free end of the cantilever. The electrical contact island has an end which is distal from the cantilever, and which carries a portion of the electrical conductor that is disposed on the second layer. In this particular aspect of the PCT patent application the portion of the electrical conductor at the end of the electrical contact island is urged by force supplied by the cantilever into intimate contact with the electrical conductor that is disposed on the first layer. In the MEMS switch, this cantilever structure provides an electrical connection to ground plate(s) which are disposed adjacent to and are electrically insulated from the MEMS switches input and output electrical conductors.

Disclosure

An object of the present disclosure is to provide an improved MEMS switch.

Another object is to provide a hermetically sealed MEMS switch using a novel combination of anodic bonding and glass frit.

Yet another object of the present invention is to provide a MEMS switch, including single-pole single-throw, or single-pole multiple-throw, or multiple-throw multiple-pole switches, that is adapted for switching radio frequency ("RF") alternating currents.

Another object of the present invention is to provide a smaller MEMS switch.

Briefly, a single-pole, double-throw ("SPDT") micro-electro mechanical systems ("MEMS") switch that selectively couples an electrical signal present on an input conductor connected to the SPDT MEMS switch to a first or a second output conductor also connected thereto, or conversely.

1. A SPDT MEMS switch includes a micro-machined monolithic layer of material having at least a pair of actutatable toggles. The pair of toggles may be configured in any desired orientation. In the preferred implementation, torsion bars support the actuating toggle from a surrounding frame. The torsion bars are on opposite sides of the toggle and establish an axis about which the toggle can rotate. Each of the toggles carries an electrically conductive shorting bar at an end thereof which is furthest from the toggle's rotation axis. Each toggle thus represents an individual single-pole single-throw (SPST) switch.
2. Another objective of the invention is to allow the construction of arbitrary arrangements of SPST toggle switches to form more complex switch networks. Many individual toggles can be created within the sealed cavity, and judicious design and layout allows the creation of a monolithic network of switches within the sealed cavity. In general, given a plurality of toggles connected in a judiciously chosen fashion, it is possible to create single-pole single-throw switches, single-pole multiple-throw switches or multiple-pole multiple-throw switches. Since each toggle element can function independently of each other toggle element it is also possible to have more than one toggle closed at the same time. Because the individual switches are very low loss, viable switch networks can be constructed with an arbitrary input connected to an arbitrary output via several switches. It is also possible to have multiple individual switch configurations within the same package; for instance, a single monolithic component can contain a SPDT MEMS switch (1×2) along with a SP4T switch (1×4). In the disclosed implementation each toggle functions independently and it is possible to close as many or as few switches as desired at any time, allowing for example a single input to be connected to multiple outputs simultaneously.

Another aspect of the present invention is a method for anodic bonding which forms a strong bond using glass frit as a gasket to hermetically seal metal feedthroughs. Included in this invention is a method of increasing the surface contact area to the sealing glass using a rail or other feature formed on the bond surface that is not initially patterned with the sealing glass. This rail or other feature will push into the sealing glass during the bonding process. It will be readily apparent to those of skilled in the art that this sealing technique can be used for various MEMS and other mechanical and electrical devices which require wafer level hermetic sealing.

These and other features, objects and advantages will be understood or apparent to those of ordinary skill in the art from the following detailed description of the preferred embodiment as illustrated in the various drawing figures.

BRIEF DESCRIPTION OF DRAWINGS

FIG. 9 is a cross-sectional elevational view of a MEMS switch in accordance with the present disclosure taken along the line 9-9 in FIG. 6;

FIG. 10 is another perspective view of a portion of the device layer of the SOI wafer fusion bonded onto the top surface of the base wafer illustrated in FIG. 4 after deposition of metallic structures in the initial cavity and formation of a pair of conrearing toggles and their supporting torsion bars;

BEST MODE FOR CARRYING OUT THE DISCLOSURE

Figure 1:
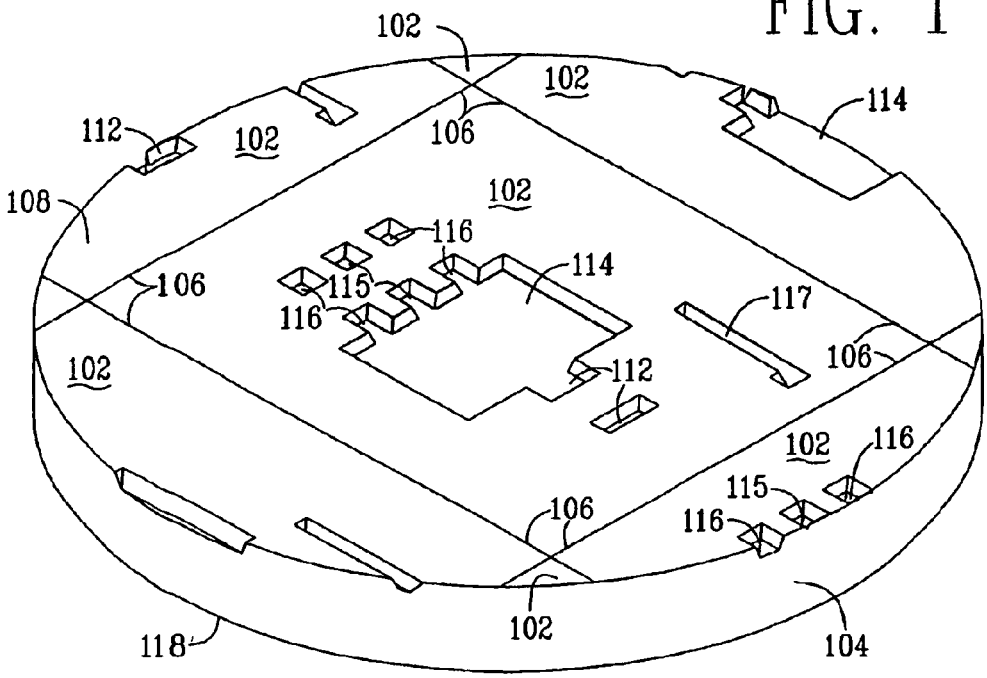
FIG. 1 is a perspective view of an area on a surface of a base wafer included in the MEMS switch into which micro-machined cavities have been formed in accordance with a preferred embodiment.

While as described below there exist various alternative processes and configurations for fabricating a MEMS switch in accordance with the present disclosure, FIG. 1 depicts an area 102 on a base wafer 104 occupied by one particular configuration for a MEMS switch. In the illustration of FIG. 1, lines 106 indicate boundaries of the central area 102 with eight (8) identical, adjacent areas 102 which, except adjacent to edges of the base wafer 104, surround the central area 102. In accordance with the following description, after the MEMS switch has been completely fabricated, the areas 102 are separated into individual MEMS switches by sawing along the lines 106.

The base wafer 104 is a conventional silicon wafer which may be thinner than a standard SEMI thickness for its diameter. For example, if the base wafer 104 has a diameter of 150 mm, then a standard SEMI wafer usually has a thickness of approximately 650 microns. However, the thickness of the base wafer 104, which can vary greatly and still be usable for fabricating a MEMS switch in accordance with the present disclosure, may be thinner than a standard SEMI silicon wafer.

Fabrication of one embodiment of a MEMS switch in accordance with the present disclosure begins first with micro-machining a pair of switched-terminals pad cavities 112, a rectangularly shaped toggle cavity 114, a pair of common-terminal feedthrough cavities 115, two pairs of electrode feedthrough cavities 116 and a substrate contact tunnel 117 into the into a top surface 108 of the base wafer 104. The depth of the cavities 112, 114, 115, 116 and 117 is not critical, but should be approximately 10 microns deep for embodiments described herein.

KOH or other wet etches is preferably used in micro-machining the cavities 112, 114, 115, 116 and 117. A standard etch blocking technique is used in micro-machining the cavities 112, 114, 115, 116 and 117. As is well known to those skilled in the art of MEMS and semiconductor fabrication, the top surface 108 of the base wafer 104 is first oxidized and patterned to provide a blocking mask for micro-machining the top surface 108 using KOH. The oxide on the top surface 108 of the base wafer 104 remaining after micro-machining is then removed. As also well known in the art, the walls of the cavities 112, 114, 115, 116 and 117 formed in this way slope at an angle of approximately 54°. If plasma etching were to be used for forming the cavities 112, 114, 115, 116 and 117 similar to the description appearing in the prior PCT patent application identified above which is hereby incorporated by reference as though fully set forth here, then a photo-resist mask would be applied to the top surface 108. This micro-machining produces the cavities 112, 114, 115, 116 and 117, particularly the toggle cavity 114 which accommodates movement of toggles to be described in greater detail below.

After the cavities 112, 114, 115, 116 and 117 have been micro-machined into the top surface 108, the next step, not illustrated in any of the FIGs., is etching alignment marks into a bottom surface 118 of the base wafer 104. The bottom side alignment marks must register with the cavities 112, 114, 115, 116 and 117 micro-machined into the base wafer 104 to permit aligning with the cavities 112, 114, 115, 116 and 117 other subsequently micro-machined structures. These bottom side alignment marks will also be used during a bottom side silicon etch near the end of the entire process flow. The bottom side alignment marks are established first by a lithography step using a special target-only-mask, aligned with the cavities 112, 114, 115, 116 and 117, and then by micro-machining the bottom surface 118 of the base wafer 104. The pattern of the target-only-mask is plasma etched a few microns deep into the bottom surface 118 before removing photo-resist from both surfaces of the base wafer 104. Creating bottom side alignment marks can be omitted if an aligner having infrared capabilities is available for use in fabricating MEMS switches.

Figure 2:
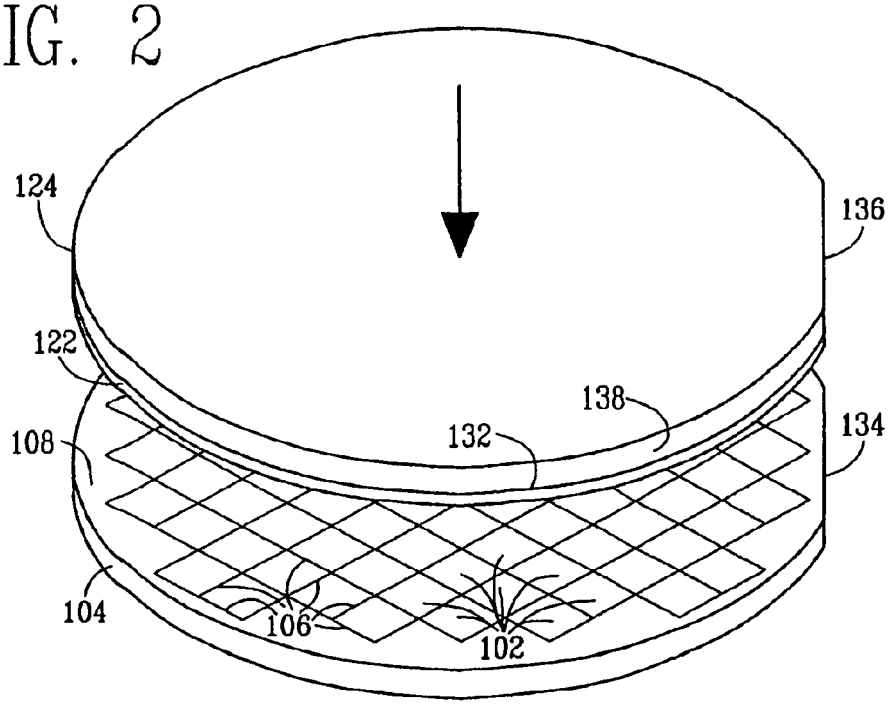
FIG. 2 is a perspective view illustrating fusion bonding of a device layer of an SOI wafer onto a top surface of the base wafer into which cavities have been micro-machined.

The next step in fabricating the MEMS switch, depicted in FIG. 2, is fusion bonding a thin, single crystal Si device layer 122 of a silicon-on-insulator ("SOI") wafer 124 to the top surface 108 of the base wafer 104. Preferably the device layer 122 of the SOI wafer 124 is 10 microns thick over an extremely thin buried layer 132 of silicon dioxide ($SiO_2$), thus its name Silicon on Insulator or SOI. A characteristic of the SOI wafer 124 which is advantageous in micro-machining MEMS switch is that the device layer 122 has an essentially uniform thickness with respect to the thin SiO2 layer 132, preferably about 10 microns, over the entire surface of the SOI wafer 124. In fusion bonding the device layer 122 of the SOI wafer 124 to the top surface 108 of the base wafer 104, the wafers 104 and 124 are aligned globally by matching an alignment flat 134 on the base wafer 104 with a corresponding alignment flat 136 on the SOI wafer 124. Fusion bonding of the SOI wafer 124 to the base wafer 104 is performed at approximately 1000° C.

Figure 3:
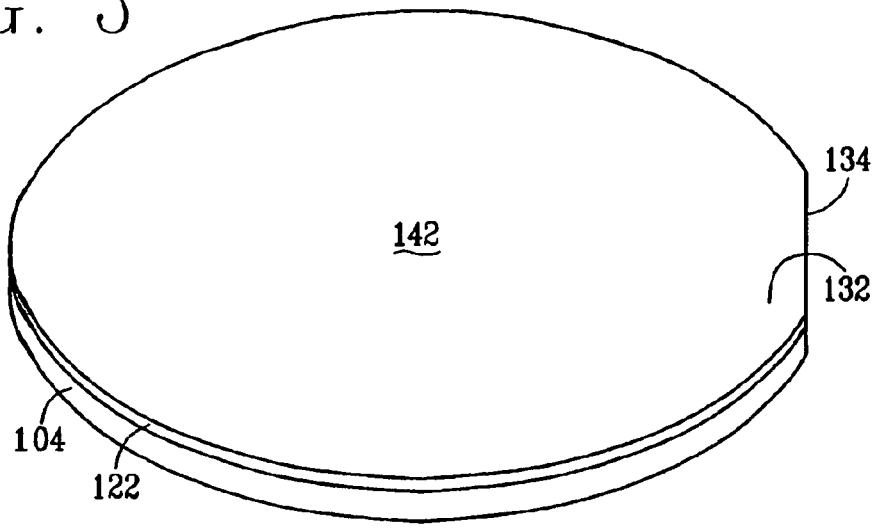
FIG. 3 is a perspective view of the device layer of the SOI wafer fusion bonded onto the top surface of the base wafer after removal of the SOI wafer's handle layer and buried $SiO_2$ layer.

After the base wafer 104 and the SOI wafer 124 have been formed into a single piece by fusion bonding, a handle layer 138 of the SOI wafer 124 located furthest from the device layer 122 and then the SiO2 layer 132 are removed leaving only the device layer 122 bonded to the top surface 108 of the base wafer 104. First a protective silicon dioxide layer, a silicon nitride layer, a combination of both, or any other suitable protective layer is formed on the bottom surface 118 of the base wafer 104. Having thus masked the base wafer 104, the silicon of the handle layer 138 is removed using a KOH or TMAH etch applied to the SOI wafer 124. Upon reaching the buried SiO2 layer 132 after the bulk of the silicon forming the handle layer 138 has been removed, the rate at which the KOH or TMAH etches the SOI wafer 124 slows appreciably. In this way, the SiO2 layer 132 functions as an etch stop for removing the handle layer 138. After the bulk silicon of the handle layer 138 has been removed, the formerly buried but now exposed SiO2 layer 132 is removed using a HF etch. Note that other methods of removing the bulk silicon of the handle layer 138 may be used including other wet silicon etchants, a plasma etch, grinding and polishing, or a combination of methods. After completing this process only the device layer 122 of the SOI wafer 124 remains bonded to the base wafer 104 as illustrated in FIG. 3. Alternatively the buried silicon dioxide layer may be left on the device layer 122 and used as a blocking mask for a subsequent etch. The buried oxide would be removed after the etch is complete.

Those of skilled in the art will realize that other methods of forming the cavities 112, 114, 115, 116 and 117 are possible. For example, the SOI wafer can be replaced by a P-type silicon wafer with an N-type epi layer deposited on it. The N-type epi layer is analogous to the device layer 122 of the SOI wafer. After the silicon fusion bond step the P-type portion of this wafer would be removed leaving just the N-type epi layer on the base wafer 104 using an electrochemical etch stop etching process.

Figure 4:
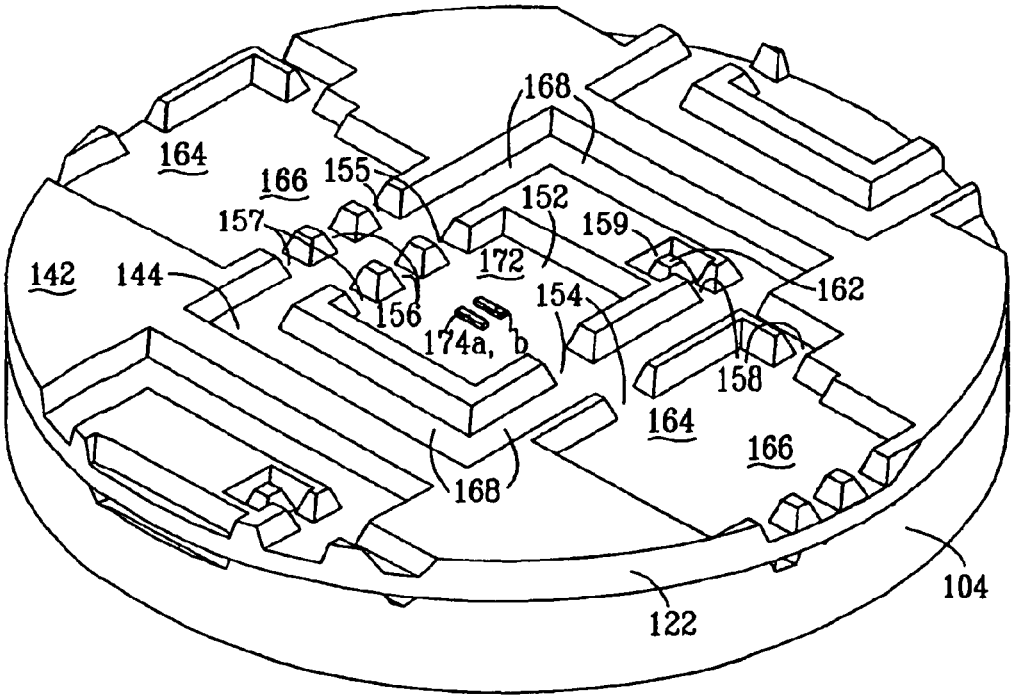
FIG. 4 is a perspective view of a portion of the device layer of the SOI wafer fusion bonded onto the top surface of the base wafer that is located immediately over the area of the base wafer depicted in FIG. 1 after formation of an initial cavity therein and deposition and patterning of an electrically insulating layer.

FIG. 4 depicts what has been exposed as a front surface 142 of device layer 122 due to etching away of the handle layer 138 and perhaps the SiO2 layer 132. Similar to forming the cavities 112, 114, 115, 116 and 117 depicted in FIG. 2, the next step in fabricating the preferred embodiment of the MEMS switch is a first micro-machining, preferably using a KOH etch, of an approximately 5.0 micron deep initial cavity 144 through the front surface 142 into the device layer 122. Micro-machining the initial cavity 144 into the device layer 122 establishes the following areas within the device layer 122.

1. a rectangularly-shaped toggle area 152
2. lead feedthrough areas 154, 155, 156 and 157
3. a substrate-contact-feedthrough area 158
4. a substrate-contact-trench area 159 located at one end of the substrate-contact-feedthrough area 158 that surrounds a substrate-contact pedestal 162
5. bonding-pad areas 164 and 166
6. a rectangularly-shaped frit-trench area 168 which encloses the toggle area 152

The areas 152, 154, 155, 156, 157, 158, 162, 166 and 168 extend upward from a floor 172 of the initial cavity 144 to the front surface 142 of the device layer 122.

After forming the initial cavity 144, insulating pads **174*a* and 174*b* are deposited onto the floor 172 of the initial cavity 144 in preparation for depositing electrically conductive metallic structures therein. A silicon oxynitride material which is roughly 10% nitride and 90% oxide is preferably deposited for the insulating pads 174*a* and 174*b* using Plasma Enhanced Chemical Vapor Deposition ("PECVD"). This silicon oxynitride material is stress-free when deposited on silicon. However, the material deposited for the insulating pads 174*a* and 174*b* could be any of an electrically insulating silicon nitride material, a silicon dioxide ($SiO_2$) material, or a combination thereof. If gold (Au) is to be deposited elsewhere on the device layer 122 and subsequent processing requires temperatures of 400° C. or greater, then depositing the electrically insulating film may be advantageously deposited in those areas to prevent alloying of the Au with the Si of the device layer 122**.

Figure 5:
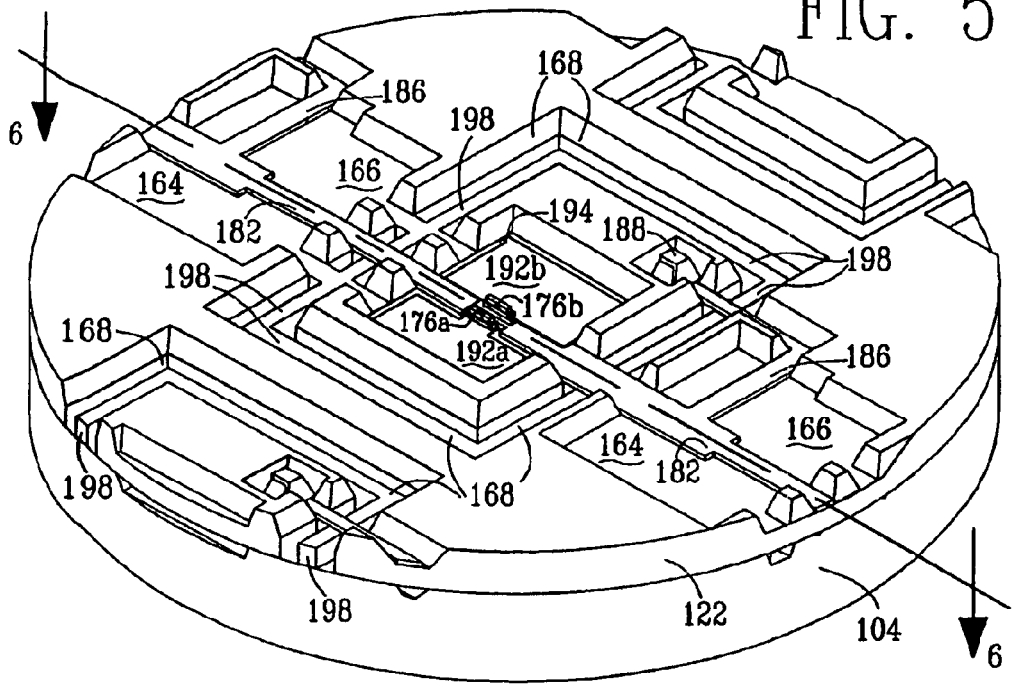
FIG. 5 is another perspective view of a portion of the device layer of the SOI wafer fusion bonded onto the top surface of the base wafer illustrated in FIG. 4 after deposition of metallic structures in the initial cavity and formation of a pair of confronting toggles and their supporting torsion bars.
Figure 6:
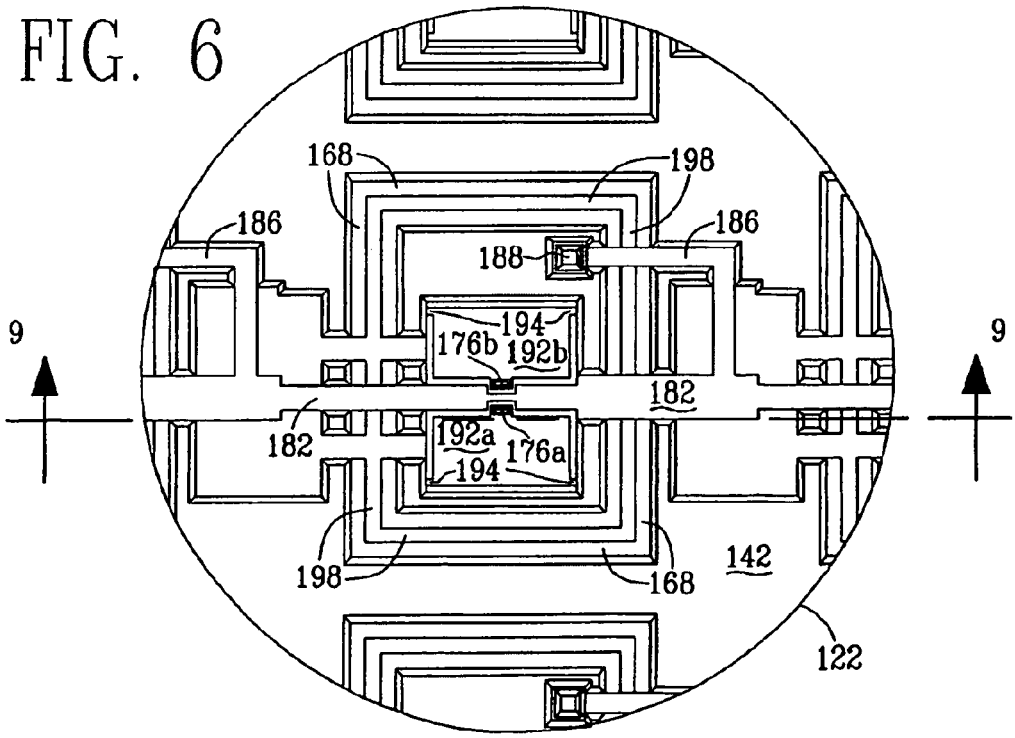
FIG. 6 is a plan view of the central portion of the initial cavity taken along the line 6-6 in FIG. 5 showing the metallic structures, the toggles and their supporting torsion bars which are located there.

FIGS. 5 and 6 depict various metallic structures which are deposited on the floor of the initial cavity 144. These metallic structures are preferably formed by a layer of Au deposited on a titanium/tungsten adhesion layer. However, these metallic structures could be deposited using any number of other material combinations such as platinum on titanium/tungsten. The metallic layer may be deposited by any of the common deposition methods used in semiconductor processing. Such deposition methods include sputtering, e-beam and evaporation.

After deposition, the metallic layer is lithographically patterned and etched to form shorting bars 176*a* and 176*b* located on the insulating pads 174*a* and 174*b*. Etching of the metallic layer also forms a metallic ground plate 182 that extends across the initial cavity 144 between the insulating pads 174*a* and 174*b* and shorting bars 176*a* and 176*b* and through the feedthrough areas 154, 156. A metallic substrate-contact lead 186 disposed within the substrate-contact-feedthrough area 158 connects the ground plate 182 to a substrate-contact pad 188 located on top of the substrate-contact pedestal 162.

After forming the metallic structures in the initial cavity 144, a plasma system, preferably a Reactive Ion Etch ("RIE") that will provide good uniformity and anisotropy, is used in piercing material of the device layer 122 remaining at the floor 172 of the initial cavity 144. However, KOH or other wet etches may also be used for this second etching of the device layer 122. A standard etch blocking technique is used for this second micro-machining the device layer 122, i.e. either photo-resist for plasma etching or a mask formed either by silicon oxide or silicon nitride for a wet, KOH etch.

As shown in FIGS. 5 and 6 this second etching applied to the floor 172 of the initial cavity 144 forms a pair of toggles 192*a* and 192*b* which are configured so the shorting bars 176*a* and 176*b* confront each other. Each of the toggles 192*a* and 192*b* is supported at one edge furthest from the shorting bars 176*a* and 176*b* by a pair of torsion bars 194. Each pair of torsion bars 194 extend between opposite sides of one of the toggles 192*a* and 192*b* and a surrounding frame provided by the silicon material of the device layer 122. Supported in this way by two torsion bars 194, each toggle 192 is rotatable about an axis which is collinear with the torsion bars 194. In this way the toggles 192*a* and 192*b* and torsion bars 194 are formed monolithically with the surrounding material of the device layer 122. The second RIE etch of the initial cavity 144 also removes material of the floor 172 within the frit-trench area 168 down to the base wafer 104 on both sides of a central rail 198 located therein. Configured in this way within the deepen frit-trench area 168 the rail 198 projects outward to the floor 172 of the initial cavity 144. The rail 198 central rail increases the surface area of contact to the glass frit. However, the rail 198 is not essential for a good hermetic seal and may be omitted.

Figure 7:
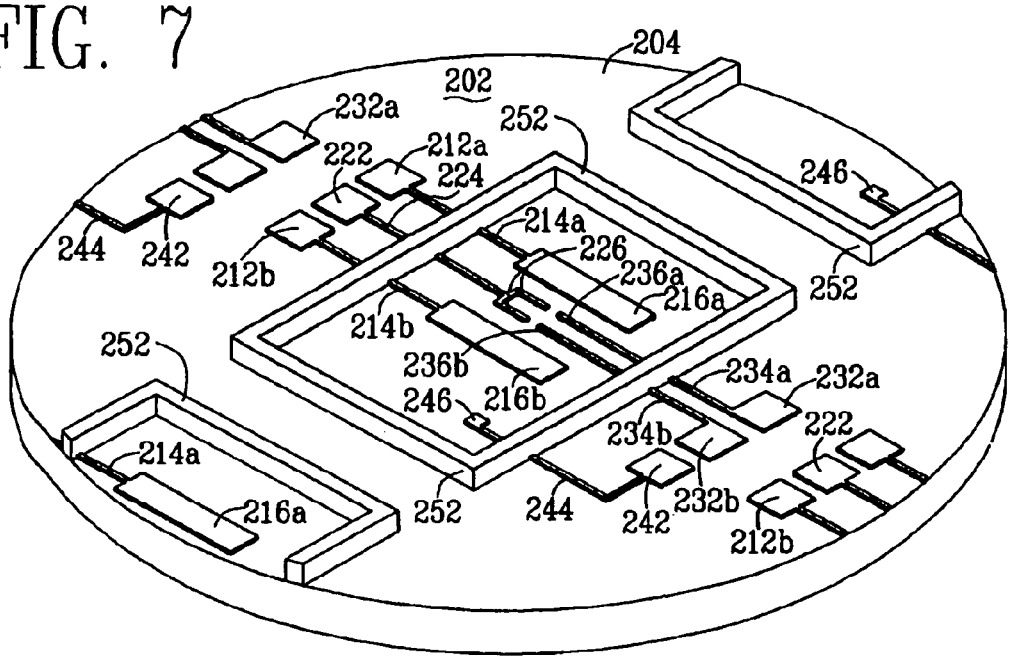
FIG. 7 is a perspective view of a portion of a glass substrate for use with confronting toggles that is mated with the area of the device layer depicted in FIGS. 5 and 6 which illustrates metal structures micro-machined thereon.

FIG. 7 depicts an area on a metalization surface 202 of a Pyrex glass substrate 204 which subsequently will be mated with and fused to the front surface 142 of the device layer 122 depicted in FIG. 5. The glass substrate 204 has the same diameter as the base wafer 104 and SOI wafer 124, and preferably is 0.5 mm thick. The illustration of FIG. 7 depicts metallic structures present atop the metalization surface 202 after first depositing a thin 1000 A° seed layer of chrome-gold (Cr—Au) or titanium/tungsten gold (TiW—Au) onto the metalization surface 202. The seed layer is then patterned after which 2.0 microns of Au is plated onto the seed layer.

This is a preferred thickness for metallic structures formed on the metalization surface 202 for RF skin effect considerations, but other thickness, metals and deposition processes may also be used. For instance a Ti/W—Au layer may be sputtered with a total thickness of 2.0 microns.

Patterning of the seed layer or etching of a thicker layer of a material such as Ti/W—Au establishes the following metallic structures.

1. a pair of electrode pads 212*a* and 212*b* connected respectively via leads 214*a* and 214*b* to actuating electrodes 216*a* and 216*b*
2. a common-terminal pad 222 connected via a common-terminal lead 224 to a pair of common-terminal contact areas 226
3. a pair of contact pads 232*a* and 232*b* connected respectively via leads 234*a* and 234*b* to switched-terminal contact areas 236*a* and 236*b*
4. a grounding pad 242 connected through a lead 244 to a pedestal-contact pad 246

In addition to the metals described above, a thin layer of hard metal is deposited onto the shorting bars 176*a* and 176*b*, the common-terminal contact areas 226 and the switched-terminal contact areas 236*a* and 236*b* using a liftoff process. Presently, platinum (Pt) is the preferred material for this thin layer because it appears to reduce "sticktion" in comparison with pure Au.

In addition to these metallic structures, FIG. 7 also depicts a rectangularly-shaped frame 252 of glass frit screened onto the glass substrate 204 of the metalization surface 202 after the metallic structures have been formed thereon. The frame 252 has a horizontal width that is slightly narrower than the width of the frit-trench area 168 at the floor 172 of the initial cavity 144. Forming the frame 252 with this width reduces the possibility that particles of frit might get onto the front surface 142 of the device layer 122 during mating with the metalization surface 202 of the glass substrate 204. The height of the frame 252 exceeds the depth of the frit-trench area 168 between the front surface 142 of the device layer 122 and the floor 172 of the initial cavity 144 formed thereinto. After the frit is screened onto the metalization surface 202 of the glass substrate 204, it is dried at about 100° C. to drive off the solvents, and then it is fired at about 400° C. in atmosphere to glassify the powdery frit. The preferred frit material has the lowest possible melting point with characteristics that roughly match thermal expansion coefficients respectively of the combined base wafer 104 and device layer 122, and of the glass substrate 204. Preferably the sealing glass is screen printed onto the glass substrate. The sealing glass may also be deposited using other techniques including sputtering, spin coating or other methods. The sealing glass can initially be placed on either the glass or silicon wafer. A preferred frit material having the characteristics outlined above is Ferro Electronic Materials' part number FX11-036 Sealing Glass.

Figure 8:
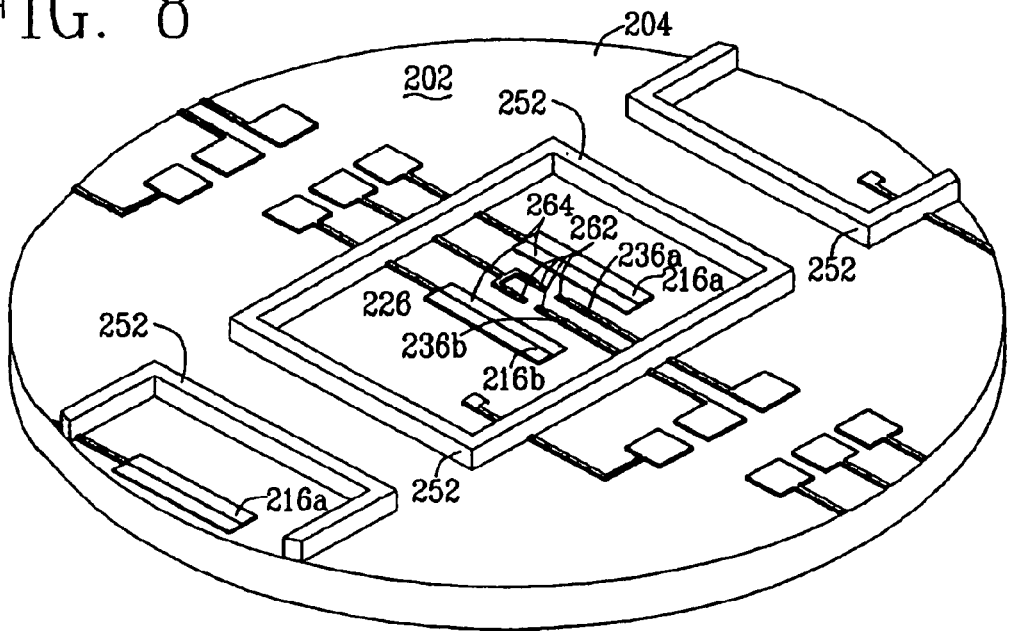
FIG. 8 is a perspective view of a portion of a glass substrate to be mated with the area of the device layer depicted in FIG. 5 which illustrates alternative embodiment metal structures micro-machined thereon depicting electrodes having a stepped cross-sectional shape.

FIG. 8 depicts an alternative embodiment of the glass substrate 204 for which a second layer of metal has been deposited and patterned before applying frit to the metalization surface 202 of the glass substrate 204. Although only two layers of metal are described herein, additional layers are possible as are thickness variations. In this embodiment, the first layer of metal is 0.5 microns thinner than the final total metal thickness. The first layer of metal is patterned as before with the following exceptions:

1. The first metal layer is removed from tips 262 of the pair of common-terminal contact areas 226 and of the switched-terminal contact areas 236*a* and 236*b* which are contacted by the shorting bars 176*a* and 176*b*; and
2. the first metal layer is removed from longitudinal halves 264 of the electrodes 216*a* and 216*b* adjacent to the pair of switched-terminal contact areas 236*a* and 236*b*.

A second layer of Ti/W followed by Au having a total thickness of 0.5 microns is sputtered or evaporated onto the patterned metallic structures described above. This second layer of metal is then patterned and etched using the same pattern depicted in FIG. 7. The resulting pattern is shown in FIG. 8. This embodiment has thinner, 0.5 micron, metal at the following locations:

1. tips 262 of the pair of common-terminal contact areas 226 and of the switched-terminal contact areas 236*a* and 236*b* which are contacted by the shorting bars 176*a* and 176*b*; and
2. longitudinal halves 264 of the electrodes 216*a* and 216*b* adjacent to the pair of switched-terminal contact areas 236*a* and 236*b*, and to the switched-terminal contact areas 236*a* and 236*b*.

Instead of the preceding process, a metal liftoff process could be used in depositing metal onto the thickened portions of the metallic structures depicted in FIG. 8. As described above for FIG. 7, the frit frame 252 is applied to the glass substrate 204 of the metalization surface 202 after the second metallic layer has been deposited, patterned and etched. The second layer of metal applied in this way provides electrodes 216*a* and 216*b* having a stepped cross-sectional shape which reduces the voltage which must be applied thereto for energizing the MEMS switch.

Having prepared the combined base wafer 104 and device layer 122 as depicted in FIGS. 5 and 6, and the glass substrate 204 as depicted in either FIG. 7 or 8, the metalization surface 202 of the glass substrate 204 is preferably bonded to the front surface 142 of the device layer 122 as follows. First, the metal pattern on the glass substrate 204 is carefully aligned with the structures on the device layer 122. Then, the glass substrate 204 and the combined device layer 122 and base wafer 104 are brought together and a force, preferably about 1800 Newtons, is applied to the glass substrate 204 and the combined device layer 122 and base wafer 104 at a temperature of approximately 400° C. When the glass substrate 204 and the combined device layer 122 and base wafer 104 are mated in this way, the frame 252 of frit encloses the toggle supporting frame provided by the silicon material of the device layer 122, the torsion bars 194 formed integrally therewith, and the toggles 192*a* and 192*b* formed integrally with the torsion bars 194. At this time additional metallic structures, not illustrated in any of the FIGs., that are located in areas of the device layer 122 and glass substrate 204 through which a saw passes when cutting the bonded wafers into individual MEMS switches electrically interconnect all of the metallic structures described above for the MEMS switch.

After stabilizing the force and temperature applied to the base wafer 104 and the combined device layer 122 and base wafer 104, a voltage is applied across the mated glass substrate 204 and combined device layer 122 and base wafer 104 for anodic bonding. Typically the voltage applied across the mated glass substrate 204 and combined device layer 122 and base wafer 104 is less than 100 volts. This potential is significantly less than the 200 to 1000 volt range for the electrical potential conventionally employed for anodic bonding. The thickness of the glass frit frame 252 causes it to contact the floor 172 of the initial cavity 144, and to compress between the floor 172 and the metalization surface 202 of the glass substrate 204. In this way, frit of the frame 252 compressed by the rail 198 within the frit-trench area 168 seals around the leads 214*a*, 214*b*, 224, 234*a*, 234*b* and 244 and bonds between the device layer 122 and the glass substrate 204. Furthermore, the temperature and pressure applied during bonding create an alloyed contact between the Au forming the pedestal-contact pad 246 on the metalization surface 202 of the glass substrate 204 and the substrate-contact pedestal 162 of the device layer 122. Any excess AU between the metalization surface 202 of the glass substrate 204 and the substrate-contact pedestal 162 of the device layer 122 flows into the substrate-contact-feedthrough area 158. Anodic bonding is preferably performed using wafer bonding equipment Model AWB-04P produced by Applied Microengineering Ltd. (AML) 173 Curie Avenue, Didcot, Oxon, OX11 OQG, United Kingdom. This equipment allows pressure-assisted anodic bonding, and allows bonding in high vacuum or in ambient gas of controlled pressure.

After bonding the glass substrate 204 to the combined device layer 122 and base wafer 104, the surface of the glass substrate 204 furthest from the metalization surface 202 and the bottom surface 118 of the base wafer 104 are thinned. Thinning is preferably accomplished by double sided grinding and polishing. Alternatively, thinning may be accomplished with wet etches such as KOH or plasma etching. More than half the thickness of each the base wafer 104 and the glass substrate 204 may be removed. Thinning of the combined device layer 122 and base wafer 104 when bonded to the glass substrate 204 yields a height for individual MEMS switches which is similar to that of standard semiconductor devices. In this way the disclosed MEMS switches are compatible with conventional automatic printed circuit board assembly equipment.

After thinning the base wafer 104 and the glass substrate 204, two more processing steps are required to complete fabrication of the MEMS switch. As described in the PCT patent application identified above, the first of these processing steps etches holes through the bottom surface 118 of the base wafer 104 completely opening the bonding-pad areas 164 and 166 thereby exposing the bonding pads 212*a*, 212*b*, 222, 232*a*, 232*b* and 242. Opening the bonding-pad areas 164 and 166 in this way is performed by first patterning the bottom surface 118 of the base wafer 104, and then plasma etching the silicon with a deep RIE system. Alternatively, a wet etch using KOH or TMAH may be used to etch the silicon. While access to the bonding pads 212*a*, 212*b*, 222, 232*a*, 232*b* and 242 is preferably obtained through the base wafer 104, as described in the PCT patent application identified above the bonding pads 212*a*, 212*b*, 222, 232*a*, 232*b* and 242 may also be accessed through the glass substrate 204 for bonding to a printed circuit board.

The final step in fabricating the MEMS switch is a dicing process using a standard silicon wafer saw to cut through the combined device layer 122 and base wafer 104 bonded to the glass substrate 204 along the lines 106 of FIG. 1 to singulate the individual MEMS switches. In addition to singulating the individual MEMS switches, sawing the combined device layer 122 and base wafer 104 bonded to the glass substrate 204 also destroys the additional metallic structures that are located in areas of the device layer 122 and glass substrate 204 through which a saw passes during dicing. In this way, sawing the combined device layer 122 and base wafer 104 bonded to the glass substrate 204 to obtain individual MEMS switches also electrically disconnects the metallic structures described above as is required for a functional MEMS switch.

Joining the combined device layer 122 and base wafer 104 to the glass substrate 204 as described above disposes the pair of common-terminal contact areas 226 and the switched-terminal contact areas 236*a* and 236*b* adjacent to and spaced apart from the shorting bars 176*a* and 176*b* respectively carried by the toggles 192*a* and 192*b* when no force is applied to the toggles 192*a* and 192*b*. In this configuration, the common-terminal contact areas 226 and the switched-terminal contact areas 236*a* and 236*b* are electrically insulated from each other. However, when a voltage applied to either or both of the electrodes 216*a* and 216*b* applies sufficient force so either or both toggles 192*a* and 192*b* rotate about the axis established by their respective pair of torsion bars 194, either or both of the shorting bars 176*a* and 176*b* respectively contact the pair of common-terminal contact areas 226 and either or both of the switched-terminal contact areas 236*a* and 236*b*.

Figure 11:
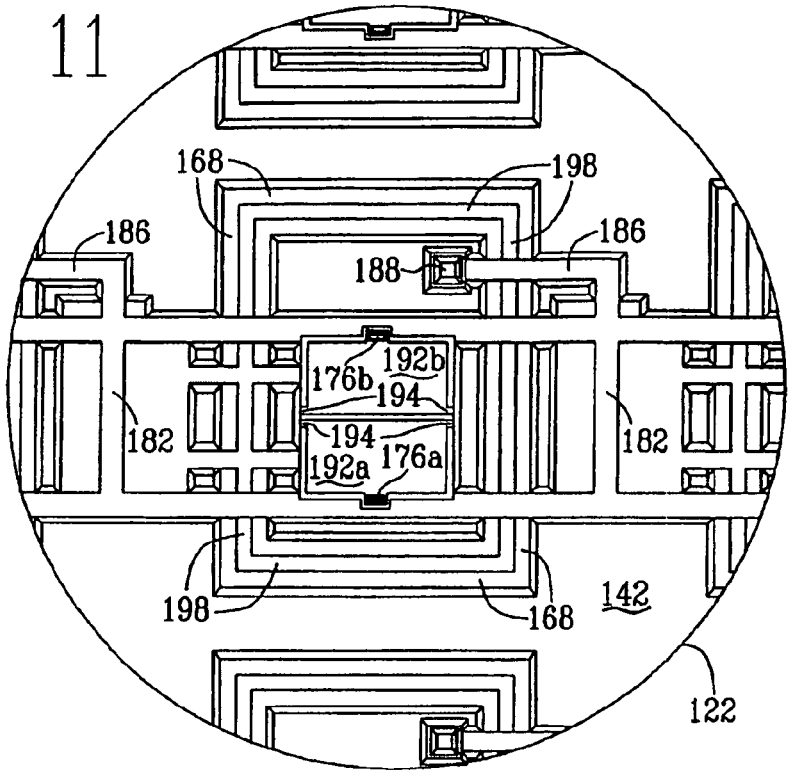
FIG. 11 is a plan view of the central portion of the initial cavity taken along the line 11-11 in FIG. 10 showing the metallic structures, the toggles and their supporting torsion bars which are located there.

FIGS. 10 and 11 depict the device layer 122 of an alternative embodiment MEMS switch which differs from the embodiment illustrated in FIGS. 5 and 6 in that the toggles 192*a* and 192*b*, rather than having a confronting arrangement, have what is identified as a conrearing arrangement. For this embodiment of the MEMS switch, rather than the shorting bars 176*a* and 176*b* being near each other and the torsion bars 194 being widely separated as in the confronting arrangement, for the conrearing arrangement the torsion bars 194 are near each other and the shorting bars 176*a* and 176*b* are widely separated from each other. Fabricating a MEMS switch having the conrearing arrangement for the toggles 192*a* and 192*b* depicted in FIGS. 10 and 11 will likely require etching cavities into the base wafer 104 which differ only slightly from that illustrated in FIG. 1. A MEMS switch having the conrearing configuration of the toggles 192*a* and 192*b* depicted in FIGS. 10 and 11 advantageously occupies a slightly smaller area on the device layer 122 than the confronting toggles embodiment depicted in FIGS. 1-9.

Figure 12:
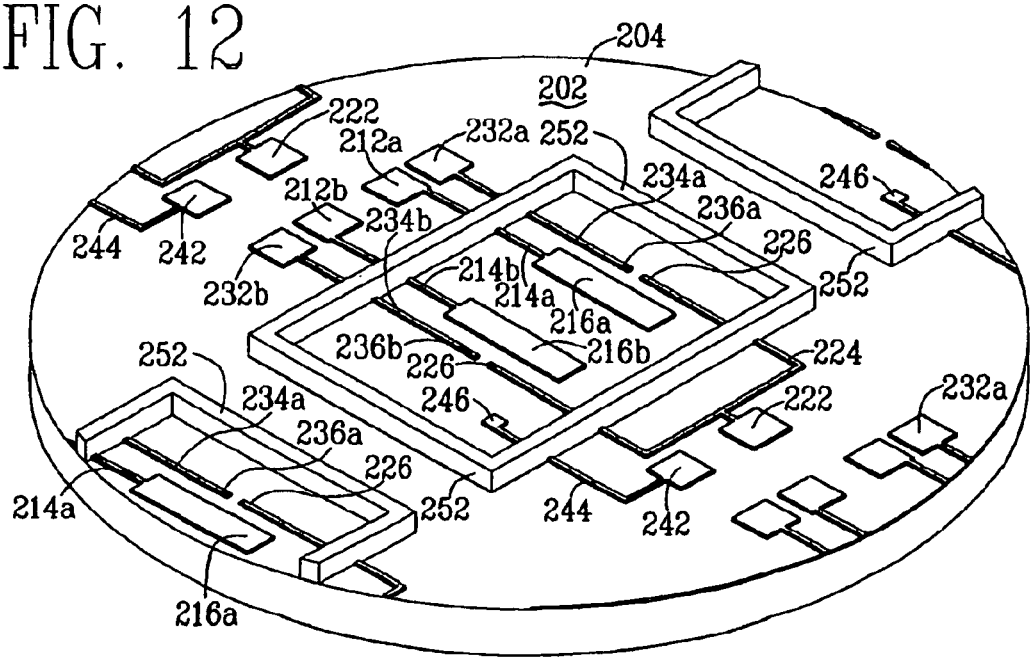
FIG. 12 is a perspective view of a portion of a glass substrate for use with conrearing toggles that is mated with the area of the device layer depicted in FIGS. 10 and 11 which illustrates metal structures micro-machined thereon.

FIG. 12 depicts an area on the metalization surface 202 of the glass substrate 204 which subsequently will be mated with and fused to the front surface 142 of the device layer 122 depicted in FIGS. 10 and 11. While the illustration of FIG. 11 fails to depict the stepped electrodes 216*a* and 216*b* that appear in FIG. 8, stepped electrodes 216*a* and 216*b* may also be used with the conrearing arrangement of toggles 192*a* and 192*b* depicted in FIGS. 10 and 11.

Figure 13:
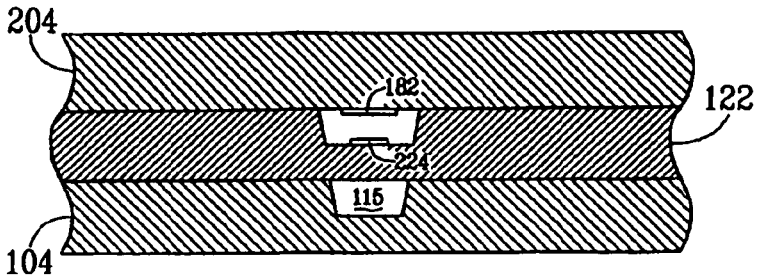
FIG. 13 is a cross-sectional view depicting a typical configuration for leads and their adjacent ground plates in MEMS switches fabricated with any of the structures depicted in FIGS. 1-12.
Figure 14:
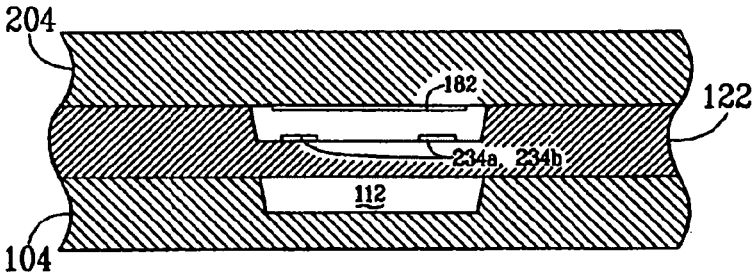
FIG. 14 is a cross-sectional view depicting an alternative configuration for two pairs of leads and their respective adjacent ground plates of the type depicted in FIG. 13.
Figure 15:
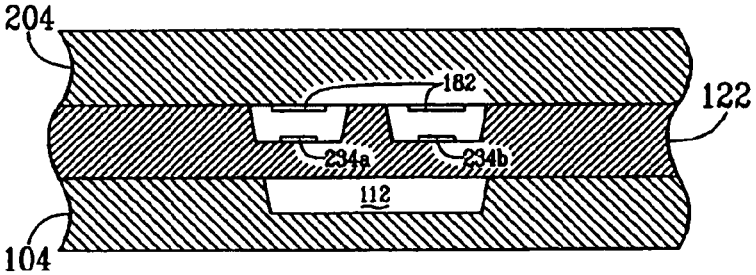
FIG. 15 is a cross-sectional view depicting an alternative configuration for two pairs of leads and their respective adjacent ground plates of the type depicted in FIG. 13 wherein a wall of silicon separates the two lead-ground plate pairs.

FIGS. 13-17 depict typical configurations for leads and adjacent ground plates in MEMS switches fabricated in accordance with the present disclosure. A MEMS device for switching high frequency RF signals with acceptable signal loss must employ some form of transmission line. A preferred transmission lines for the disclosed MEMS switch appears in the cross-sectional view of FIG. 13. That FIG. depicts a typical configuration for the common-terminal lead 224 and the adjacent ground plate 182 for the confronting arrangement of the toggles 192*a* and 192*b* appearing in FIGS. 1-9. FIG. 13 also depicts the transmission line configuration that exists for all of the leads in the conrearing arrangement of the toggles 192*a* and 192*b* depicted in FIGS. 10-12. FIG. 14 depicts a typical configuration for the leads 234*a* and 234*b* with their adjacent ground plate 182 for the confronting arrangement of the toggles 192*a* and 192*b* depicted in FIGS. 1-9. FIG. 15 depicts an alternative configuration to that of FIG. 14 in which the ground plate 182 is split in two longitudinally and a wall of silicon material of the device layer 122 separates the leads 234*a* and 234*b*.

Figure 16:
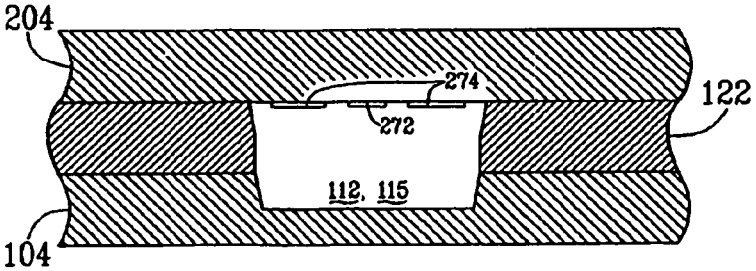
FIG. 16 is a cross-sectional view depicting another alternative configuration for leads and their respective adjacent ground plates wherein the ground plates are coplanar with and adjacent to the lead.
Figure 17:
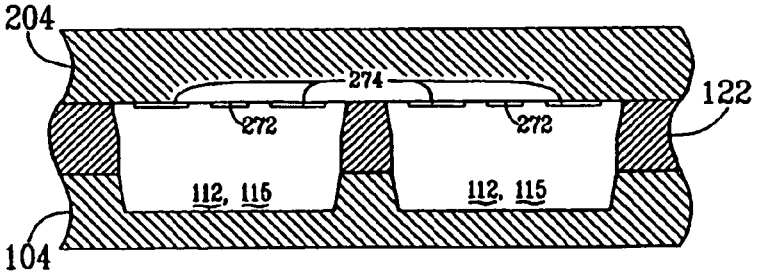
FIG. 17 is a cross-sectional view depicting another alternative configuration for leads and their respective adjacent ground plates of the type depicted in FIG. 17 wherein a wall of silicon separates the two lead-ground plate pairs.

FIG. 16 depicts a different transmission line configuration in which a lead 272 is positioned between a pair of coplanar ground plates ground plates 274. Because applying a voltage to the electrodes 216*a* and 216*b* requires an electrical connection to the silicon material of the base wafer 104 and the device layer 122, reducing signal loss for the transmission line configuration depicted in FIG. 16 requires increasing space between the lead 272 and nearby silicon material. Consequently, when fabricating a MEMS switch having the configuration depicted in FIG. 16 the second RIE etch of the device layer 122 removes more material of the floor 172 where the ground plate 182 is located. Removing material where the ground plate 182 is located opens the common-terminal feedthrough cavities 115, electrode feedthrough cavities 116 and switched-terminals pad cavities 112 that are etched into the base wafer 104 prior to fusion bonding the device layer 122 to the base wafer 104. Analogous to the transmission line configuration depicted in FIG. 15, a wall of silicon may separate a pair of leads 272 and their associated coplanar ground plates 274 thereby mechanically reinforcing the lead cavities.

INDUSTRIAL APPLICABILITY

The depth of floor 172 of the initial cavity 144 etched into the device layer 122 is critical and is stated in this embodiment as being 5.0 microns. However, the depth of the floor 172 must be chosen carefully to provide a desired gap between the shorting bars 176*a* and 176*b* carried on the toggles 192*a* and 192*b* and the common-terminal contact areas 226 and the switched-terminal contact areas 236*a* and 236*b* on the base wafer 104, taking into consideration the desired thickness of the toggles 192*a* and 192*b* and the thickness of the device layer 122.

The MEMS switch's performance when switching high frequency RF signals is significantly enhanced by the presence of a ground plane at the surface of the glass substrate 204 furthest from the metalization surface 202. If access to the bonding pads 212*a*, 212*b*, 222, 232*a*, 232*b* and 242 is obtained through the base wafer 104 as described above, then a metallic ground plane is preferably applied to the MEMS switch's exterior surface on the surface of the glass substrate 204 furthest from the metalization surface 202. When assembled onto a printed circuit board, this ground plane applied to the exterior surface of the glass substrate 204 can be electrically connected to the printed circuit board's traces by a conductive epoxy material. If alternatively access to the bonding pads 212*a*, 212*b*, 222, 232*a*, 232*b* and 242 is obtained through the glass substrate 204 as described in the PCT patent application identified above, then a patterned area on the printed circuit board may alternatively provide ground plane at the surface of the glass substrate 204 furthest from the metalization surface 202.

Depending upon precise details of how conductors are arranged in a circuit external to the MEMS switch, the common-terminal contact areas 226 may be connected via the common-terminal pad 222 to an input conductor while the switched-terminal contact areas 236*a* and 236*b* are respectively connected via the contact pads 232*a* and 232*b* to first and second output conductors. When connected to such an external circuit, the pair of common-terminal contact areas 226 connect in common to the external circuit's input conductor while the switched-terminal contact areas 236*a* and 236*b* connect individually to one of the external circuit's output conductors. Alternatively, without altering the MEMS switch the switched-terminal contact areas 236*a* and 236*b* may respectively connect via the contact pads 232*a* and 232*b* to first and second input conductors of an external circuit while the common-terminal contact areas 226 connect via the common-terminal pad 222 to a single output conductor of the external circuit.

Although the present invention has been described in terms of the presently preferred embodiment, it is to be understood that such disclosure is purely illustrative and is not to be interpreted as limiting. Consequently, without departing from the spirit and scope of the disclosure, various alterations, modifications, and/or alternative applications of the disclosure will, no doubt, be suggested to those skilled in the art after having read the preceding disclosure. Accordingly, it is intended that the following claims be interpreted as encompassing all alterations, modifications, or alternative applications as fall within the true spirit and scope of the disclosure.

What is claimed is:

1. A MEMS device comprising:

a first layer of material; and a second layer of material wherein frit material bonds the first layer of material to the second layer of material, during bonding the frit material being compressed by a rail located within a layer of material selected from a group which includes the first layer of material and the second layer of material, said rail being disposed within a frit trench that receives the frit material.

2. The MEMS device of claim 1 wherein the frit material is anodically bonded between the first layer of material and the second layer of material.

3. The MEMS device of claim 2 wherein while establishing the frit bond between the first layer of material and the second layer of material a voltage of less than one-hundred (100) volts is applied across the first layer of material and the second layer of material.

4. A method for bonding together layers of a MEMS device comprising the steps of:

disposing frit material between a mated first layer of material and second layer of material of a MEMS device;

applying pressure across the mated first layer of material and second layer of material;

heating the mated first layer of material and second layer of material; and applying an electrical potential across the mated first layer of material and second layer of material.

5. The method of claim 4 wherein the pressure applied across the mated first layer of material and second layer of material is at least 1800 Newtons.

6. The method of claim 4 wherein the mated first layer of material and second layer of material are heated to at least 400° C.

7. The method of claim 4 wherein the frit material is compressed by a rail located within a layer of material selected from a group which includes the first layer of material and the second layer of material.

8. The method of claim 7 wherein the rail is disposed within a frit trench that receives the frit material.

9. The method of claim 4 wherein the electrical potential applied across the mated first layer of material and second layer of material is less than 100 volts.

* * * * *